US006129415A

United States Patent [19]

Galloway

[11] Patent Number: 6,129,415

[45] Date of Patent: Oct. 10, 2000

[54] SHOCK ABSORPTION SYSTEM FOR WHEELCHAIR

[76] Inventor: Robert Galloway, P.O. Box 132, Kellerton, Iowa 50133

[21] Appl. No.: 09/193,356

[22] Filed: Nov. 17, 1998

[51] Int. Cl.[7] ..... A47C 1/02

[52] U.S. Cl. ..... 297/68; 297/423.26; 297/DIG. 4

[58] Field of Search ..... 297/68, 423.26, 297/440.24, 423.42, 452.2, 423.2, DIG. 4; 248/616, 636; 280/250.1, 304.1

[56] References Cited

U.S. PATENT DOCUMENTS 1,362,692 12/1920 Goldstein .
2,145,037 1/1939 Bennett .
2,481,970 9/1949 Bell .
2,852,883 9/1958 Walsh .
5,556,157 9/1996 Wempe .

*Primary Examiner*—Milton Nelson, Jr.
*Attorney, Agent, or Firm*—Brett J. Trout; Brown, Winick, Graves, Gross, Baskerville and Schoenebaum, PLC

[57] ABSTRACT

An improved wheel chair leg rest shock absorption apparatus. The apparatus includes a frame having a telescoping linkage slidably received therein. A leg rest is coupled to the linkage and means are coupled to the linkage for extending and retracting it. A spring assembly is coupled to the leg rest to absorb shock force applied to the leg rest and prevent deformation and damage to the apparatus. The spring assembly absorbs shock regardless of whether the leg rest is raised or lowered.

12 Claims, 4 Drawing Sheets

10
22
28
20
30
34
36
40
38
46
48
50
52
54
56
58
60
62
64
66
68
70
72
74
76
78
80

10
22
28
20
30
34
36
40
38
46
48
50
52
54
56
58
60
62
64
66
68
70
72
74
76
78
80

SHOCK ABSORPTION SYSTEM FOR WHEELCHAIR

BACKGROUND OF THE INVENTION

1. Field of the Invention

This invention relates to a leg extension system for wheelchairs, and, more specifically, a leg extension system which prevents damage to articulating leg rests.

2. Description of the Prior Art

It is known in the art to provide either a powered or manual reclining seating system for a wheelchair, including a reclining backrest and articulating leg rest. An example of such a device is described in U.S. Pat. No. 5,556,157 to Wempe. Wempe describes a powered system that articulates a pair of leg rests in conjunction with a no-shear backrest.

One of the problems associated with the prior art reclining seating systems is the fragility of the articulated leg rests. When manipulating wheelchairs through doors, users often utilize the leg rests to catch the door, prop the door open, and close the door afterward. Leg rests are also subjected to impact when users accidentally strike objects with the leg rests, or attempt to move objects with the leg rests. Repeated shocks to the leg rests can deform them and cause them to become inoperable. Increasing the strength of the components would lead to undesirable increases in weight and cost, and would require more effort to operate the system.

For the foregoing reasons, it would be desirable to provide an articulated leg extension system for a wheelchair with means to protect the articulating leg extensions and prevent them from becoming inoperable or deformed upon impact. It would also be desirable to accomplish this without significantly increasing the weight of the system. The difficulties encountered in the prior art discussed herein above are substantially eliminated by the present invention.

SUMMARY OF THE INVENTION

The present invention comprises an improved wheelchair leg rest extension apparatus having a frame. A telescoping linkage is slidably received by the frame, and a leg rest is coupled to the linkage. Means are operably coupled to the linkage for extending and retracting the linkage, and means are operably coupled to the leg rest for absorbing shock.

In the preferred embodiment, the shock absorbing means includes a spring, coupling the telescoping linkage to the extending and retracting means. Preferably, when the leg rest is impacted, the impact is transferred to the spring, rather than directly to the telescoping linkage. The spring is preferably capable of absorbing a sufficient amount of shock to reduce deformation and damage to the apparatus when shock is applied to the leg extension.

DETAILED DESCRIPTION OF THE PREFERRED EMBODIMENT

Figure 1:
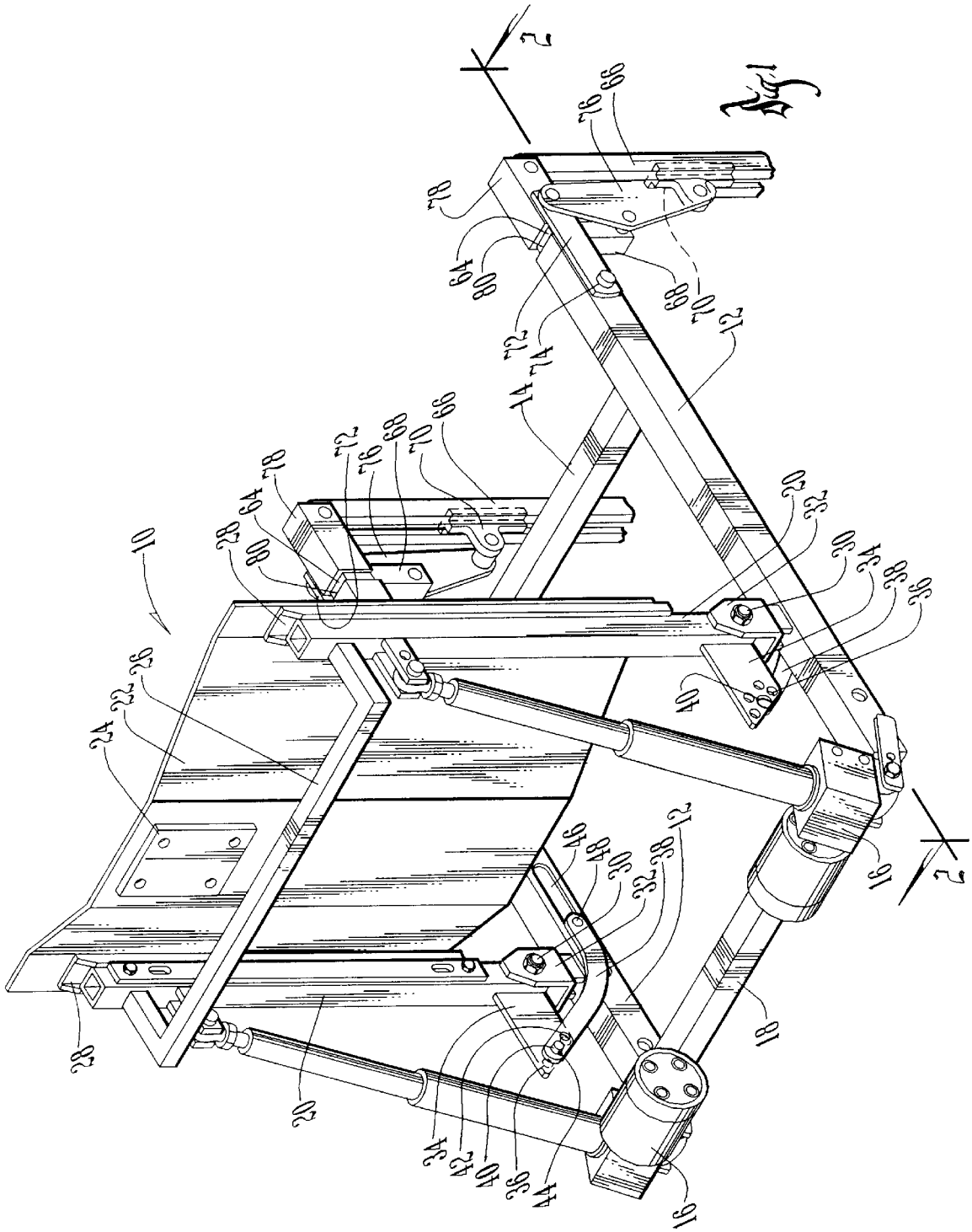
FIG. 1 perspective view of an improved wheelchair leg extension system of the present invention.

With reference to the drawings, an improved leg extension system for an electric wheelchair is shown generally as (10) in FIG. 1. The leg extension system (10) includes a pair of steel sleeves (12) interconnected by a forward cross member (14). A pair of linear actuators (16) are pivotally secured to the sleeves (12) and interconnected to one another by a rearward cross member (18). The linear actuators (16) are also pivotally connected to a pair of back support members (20). Spanning between, and secured to, the back support members (20) is a backrest (22). While the leg extension system (10) is generally comprised of tubular steel construction, the backrest (22) may be constructed of vinyl, leather or other supple material. Conversely, the backrest (22) may be constructed of a thin sheet of steel covered with supple material. As shown in FIG. 1, a headrest mount (24) may be secured to the backrest (22) for subsequent attachment of a headrest (not shown).

To provide the backrest (22) with additional support, a support bracket (26) is secured to the back support members (20) by weldments or similar securement means. The backrest (22) is supplied with a pair of glides (28) which slidably secure the backrest (22) to the back support members (20). The back support members (20), in turn, are pivotally secured to the sleeves (12) by a bolt (30) passing through a back mount (32). Extending from the back support members (20) are a pair of cantilevers (34). As shown in FIG. 1, the cantilevers (34) are provided with a plurality of adjustment holes (36). A pair of transfer linkages (38) are secured to the cantilevers (34) by a pair of bolts (40). As shown, the transfer linkages (38) are also provided with a plurality of holes (42). The spacing of the holes (42) of the transfer linkages (38) and the adjustment holes (36) of the cantilevers (34) allows specific placement of the bolts (40) to adjust the leg extension system (10) as described below. The bolt (40) is held within the holes (42) of the transfer linkages (38) and adjustment holes (36) of the cantilevers (34) by a cotter pin (44).

Figure 2:
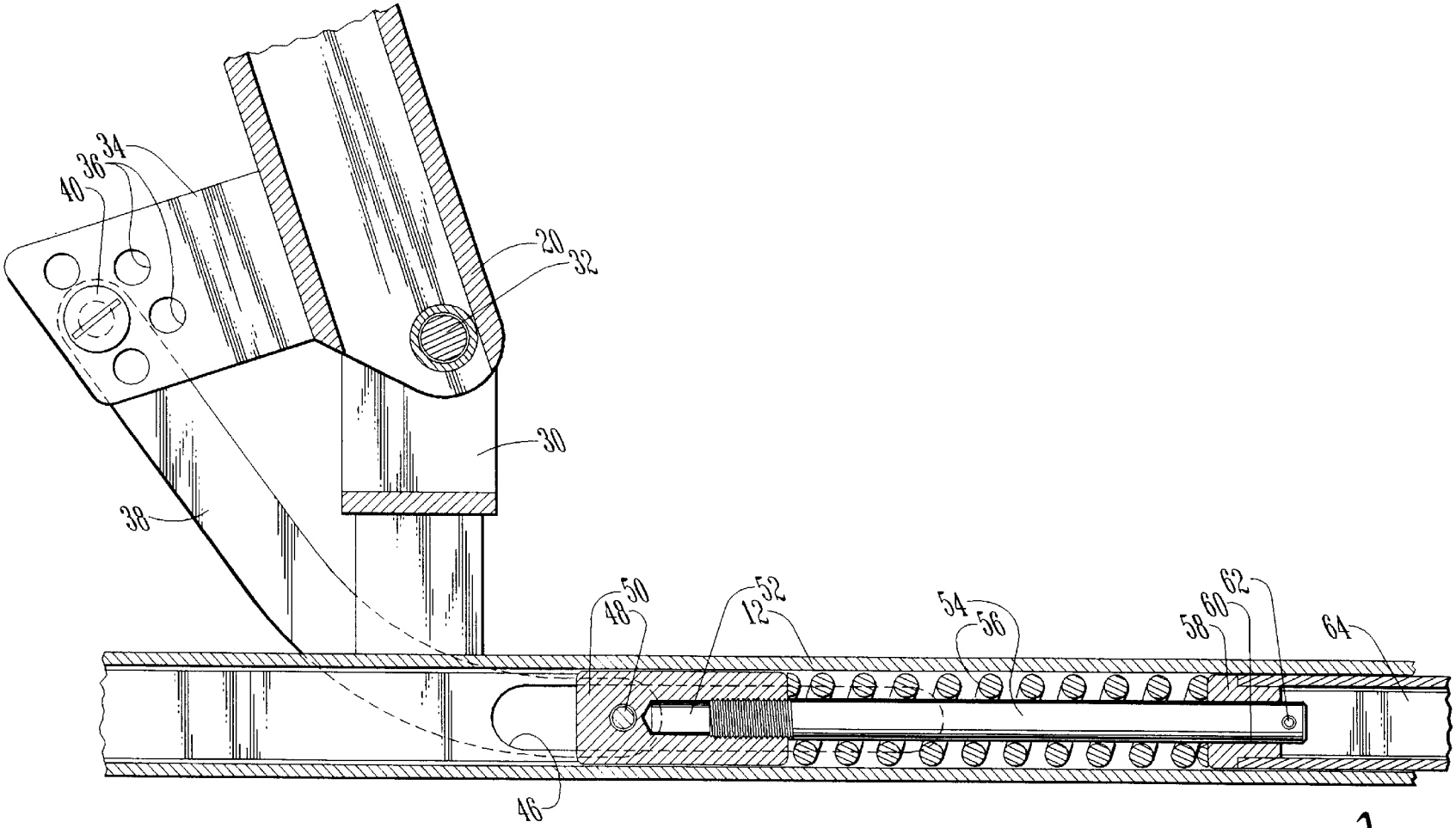
FIG. 2 is a side view in cross-section taken along line 2—2 of FIG. 1 of the improved shock absorption system of the present invention.

As shown in FIG. 2, the sleeve (12) is provided with a cutout (46) through which passes a bolt (48). The bolt (48) interconnects the transfer linkage (38) with a steel cap (50) located within the sleeve (12). The cap (50) is provided with a bore (52) into which is secured a rod (54) by threaded connection or similar attachment means. Provided around the rod (54) is a spring (56). The spring is preferably steel and may be provided with any suitable tension. Alternatively, a plurality, typically ten to twenty, of conical style spring washers, known in the art as Belleville washers, may be positioned around the rod (54) instead of a standard spring (56). The rod (54) extends through a stop (58) provided with a hole (60). A pin (62) is secured through the rod (54) to prevent the rod (54) from becoming inadvertently dislodged from the stop (58). Preferably the spring (56) is maintained under tension to prevent the stop (58) from undesired movement relative to the cap (50). As shown in FIG. 2, the stop (58) is secured to a telescoping linkage (64) provided within the sleeve (12).

Figure 3:
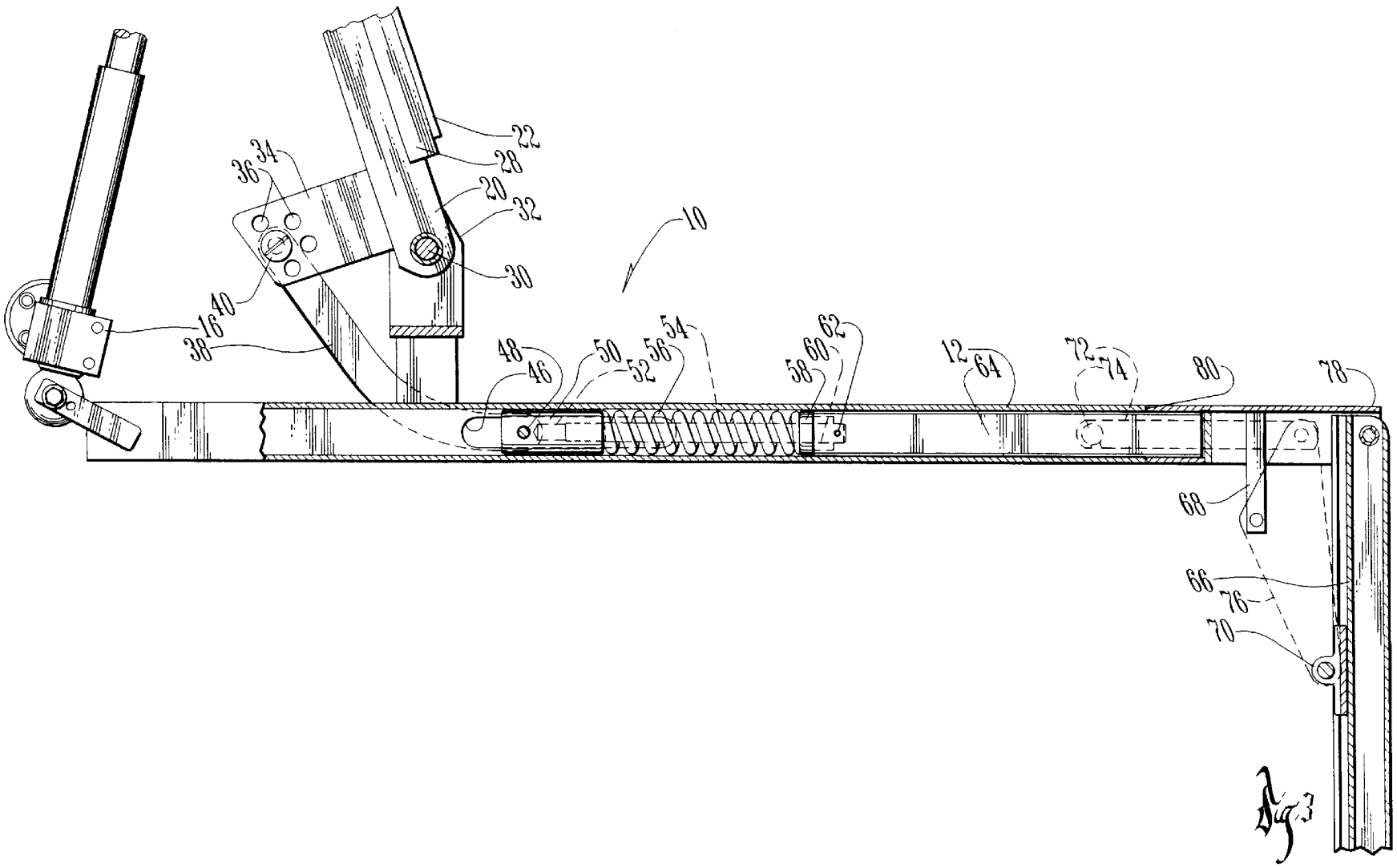
FIG. 3 is a side view in cross-section taken along line 2—2 of FIG. 1.

As shown in FIG. 3, the leg rest (66) is formed with a slot having a T-shaped cross-section. A slidable attachment ear (70) is slidably received within the slot of the leg rest (66). As shown in FIG. 1, a linkage (72) is provided with a U-shaped slot which is releasably secured around a bolt (74) provided on the sleeve (12) to pivotally secure the linkage (72) to the sleeve (12). As shown in FIG. 1, a triangular pivot plate (76) is pivotally secured to the ear (70), the fulcrum (68), and the linkage (72). The dimensions of the triangular pivot plate (76) may be manipulated in conjunction with the dimensions of the fulcrum (68) and linkage (72) to raise and lower the leg rest (66) as much or as little as desired. In the preferred embodiment, the pivot plate (76), linkage (72) and fulcrum (68) do not extend beyond the top of the telescoping linkage (64), thereby allowing the pivot point of a user's leg (not shown) to be positioned closer to the pivot point of the leg rest (66). This proximity of pivot points reduces shear on the user's leg as the leg rest (66) is raised and lowered.

As shown in FIG. 1, the fulcrum (68) is secured to a knee-joint assembly (78). The knee-joint assembly (78) is slid over the end (80) of the telescoping linkage (64) and held in place by a detent (not shown). As shown in FIG. 1, the knee-joint assembly (78) is pivotally secured to the leg rest (66). If it is desired to remove the leg rest (66), the linkage (72) is lifted from the bolt (74) and the knee-joint assembly (78) is slid from the end (80) of the telescoping linkage (74). Removal of the leg rest (66) facilitates transfer of a user to and from the seat by preventing interference from the leg rest (66) and devices attached thereto.

Figure 4:
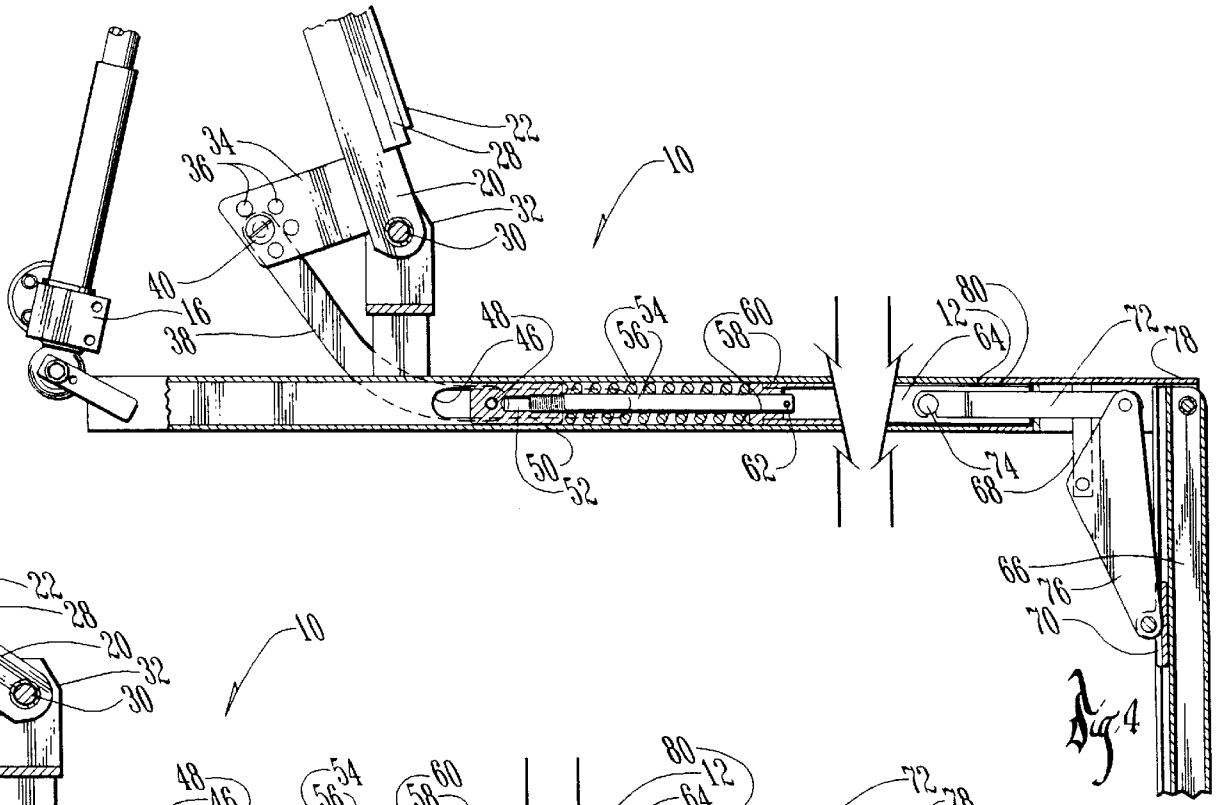
FIG. 4 is a side view in partial cross-section taken along line 2—2 of FIG. 1 showing the backrest and leg rest in the upright position.

As shown in FIG. 4, when the leg extension system (10) is in the full upright position, the leg rest (66) is in the full downward position. It should be noted that although the telescoping linkage (64) is retracted within the sleeve (12), there is a small amount of space between the knee joint assembly (78) and the end of the sleeve (12). Accordingly, when the foot rest (not shown) of the leg rest (66) contacts a door or wall (not shown), and pressure is exerted against the knee joint assembly (78), the force is absorbed by the spring (56) rather than directly by the cap (50) and transfer linkage (38). As the telescoping linkage (64) moves rearward, pressure is transferred onto the stop (58) and onto the spring (56). The rod (54) remains relatively stationary until the force is removed. As the force is withdrawn, the spring (56) forces the stop (58) and telescoping linkage (64) forward into its original position.

Figure 5:
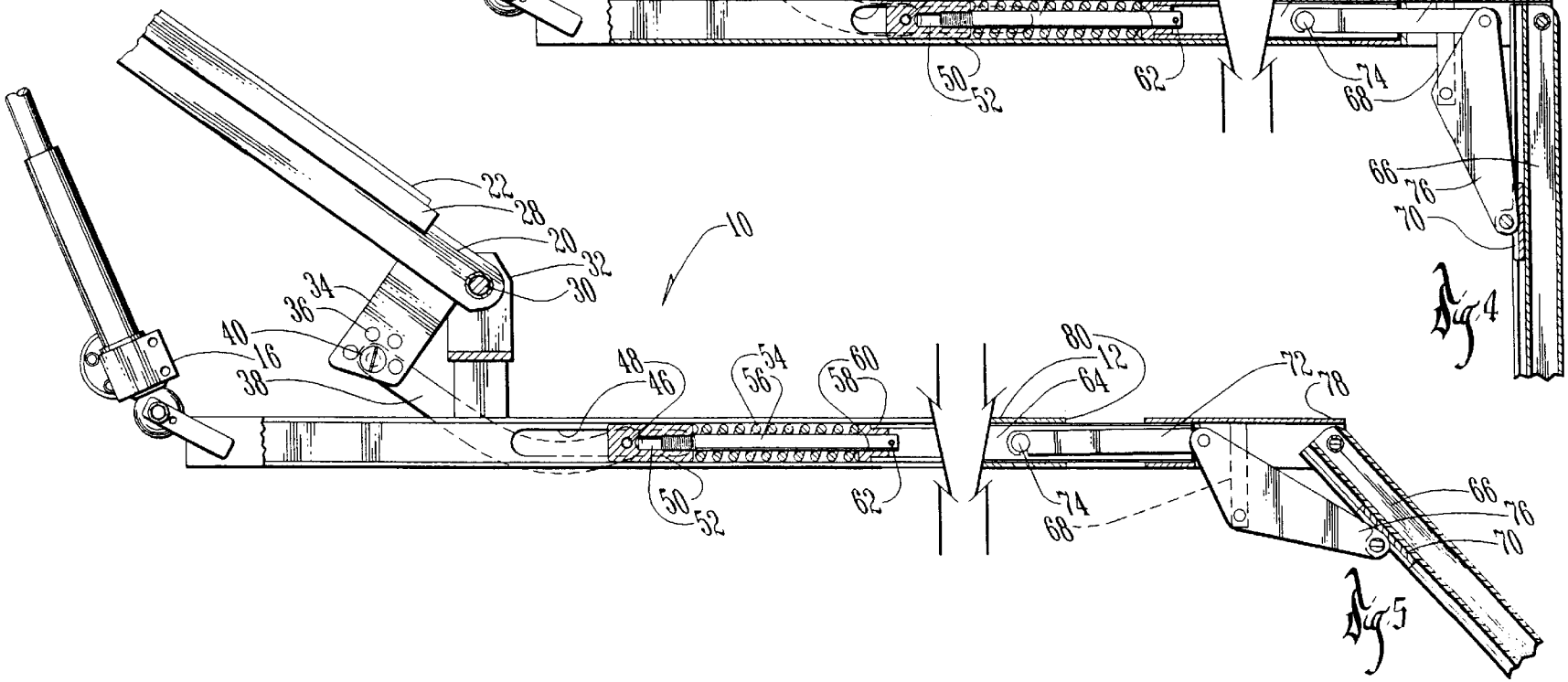
FIG. 5 side view in partial cross-section of the backrest and leg extension of FIG. 4 shown the reclined and extended position.

As shown in FIGS. 1 and 5, the linear actuators (16) are actuated to recline the back support members (20) which, in turn, extend the telescoping linkage (64) and rotate the leg extension system (10) into its fully extended position. Alternatively, the linear actuators (16) may be replaced with a manual crank (not shown) to recline the back support members (20). As the back support members (20) begin to recline, they pivot the cantilevers (34) which, in turn, force the transfer linkage (38) forward into the cap (50). (FIGS. 2 and 5). As the cap (50) moves forward, the force is transferred through the spring (56) to the stop (58) and telescoping linkage (64). As shown in FIG. 5, as the telescoping linkage (64) moves forward, the fulcrum (68) moves forward, rotating the pivot plate (76). As the pivot plate (76) rotates relative to the linkage (72), the lower end of the pivot plate (76) rotates upward, forcing the ear (70) upward along the slot and forcing the leg rest (66) upward. Even in this extended position, the spring (56) absorbs shock to the leg rest (66) and prevents damage to the leg extension system (10). When the leg rest (66) is subjected to a shock or force, such as a wall or door striking the leg rest (66), the force is transmitted from the leg rest (66) to the telescoping linkage (64) into the stop (58) and thereafter into the spring (56). As the force moves the telescoping linkage (64) rearward, the stop (58) compresses the spring (56) against the cap (50) until the force of the spring (56) overcomes the force on the leg rest (66). As the force on the leg rest (66) is removed, the spring (56) expands to its original position. By absorbing the shock with the spring (56), deformation and damage of the leg rest (66), telescoping linkage (64), transfer linkage (38) and other components of the leg extension system (10) are substantially eliminated. By moving the bolts (40) to different holes (42) and adjustment holes (36), the amount of travel of the leg rest (66) relative to the amount of travel of the back support members (20) can be adjusted to accommodate various users.

The foregoing description and drawings merely explain and illustrate the invention and the invention is not limited thereto except insofar as the claims are so limited, as those skilled in the art who have the disclosure before them will be able to make modifications and variations therein without departing form the scope of the invention. For example, it is anticipated that the pivot plate may be formed of any suitable dimensions and that the spring may be replaced with any suitably resilient material.

What is claimed is:

1. An improved wheel chair leg rest shock absorption apparatus comprising:

(a) a frame;

(b) a telescoping linkage slidably received by said frame;

(c) a leg rest coupled to said linkage;

(d) means operably coupled to said linkage for extending and retracting said linkage; and (e) means operably coupled to said leg rest for absorbing shock force applied to said leg rest wherein said shock absorbing means is resilient means secured between said frame and said leg rest for allowing said leg rest to move from a starting position relative to said frame and means for biasing said leg rest back to said starting position.

2. The improved wheel chair leg rest shock absorption apparatus of claim 1, wherein said leg rest is pivotally connected to said telescoping linkage.

3. The improved wheel chair leg rest shock absorption apparatus of claim 2, further comprising means for pivoting said leg rest in a first direction upon extension of said linkage and for pivoting said leg rest in a second direction upon retraction of said linkage.

4. The improved wheel chair leg rest shock absorption apparatus of claim 1, wherein said shock force absorbing means is a spring.

5. The improved wheel chair leg rest shock absorption apparatus of claim 1, wherein said frame includes a frame tube and wherein said telescoping linkage is operably received within said frame tube.

6. The improved wheel chair leg rest shock absorption apparatus of claim 1, wherein said shock force absorbing means is secured between said telescoping linkage and said extending and retracting means.

7. The improved wheel chair leg rest shock absorption apparatus of claim 1, wherein said shock force absorbing means is secured between said leg rest and said telescoping linkage.

8. An improved wheel chair leg rest shock absorption apparatus comprising:

(a) a frame;

(b) a telescoping linkage slidably received by said frame;

(c) a leg rest coupled to said linkage;

(d) means operably coupled to said linkage for extending and retracting said linkage; and (e) means operably coupled to said leg rest for absorbing shock force applied to said leg rest wherein said shock force absorbing means comprises:

(i) a stop secured to said telescoping linkage, said stop being provided with a hole;

(ii) a shaft having a first end and a second end, wherein said first end is slidably received through said hole and wherein said second end is operably coupled to said extending and retracting means;

(iii) means secured to said first end of said shaft for preventing removal of said first end of said shaft through said hole; and (iv) a spring provided around said shaft.

9. An improved wheel chair leg rest shock absorption apparatus comprising:

(a) a frame having a frame tube;

(b) a telescoping linkage slidably received within said frame tube;

(c) a leg rest pivotally coupled to said telescoping linkage;

(d) means operably coupled to said linkage for extending and retracting said linkage;

(e) a stop secured to said telescoping linkage, said stop being provided with a hole;

(f) a shaft having a first end and a second end, wherein said first end is slidably received through said hole and wherein said second end is operably coupled to said extending and retracting means;

(g) means secured to said first end of said shaft for preventing removal of said first end of said shaft through said hole; and (h) a spring provided around said shaft.

10. The improved wheel chair leg rest shock absorption apparatus of claim 9, wherein said leg rest is pivotally connected to said telescoping linkage.

11. The improved wheel chair leg rest shock absorption apparatus of claim 9, further comprising means for pivoting said leg rest in a first direction upon extension of said linkage and for pivoting said leg rest in a second direction upon retraction of said linkage.

12. The improved wheel chair leg rest shock absorption apparatus of claim 9, wherein said spring is at least three centimeters long.

* * * * *